US007219457B2

(12) United States Patent
Carter et al.

(10) Patent No.: US 7,219,457 B2
(45) Date of Patent: May 22, 2007

(54) MODULAR PEDESTAL AND SUSPENDED SIGNS

(75) Inventors: Wallace T. Carter, Wilmington, NC (US); Brad Forrest, Cary, NC (US); Tom Hines, West Rocky Point, NC (US); Mac McRorie, Raleigh, NC (US)

(73) Assignee: ArchiForm, Inc., Wilmington, NC (US)

( * ) Notice: Subject to any disclaimer, the term of this patent is extended or adjusted under 35 U.S.C. 154(b) by 40 days.

(21) Appl. No.: 10/750,968

(22) Filed: Jan. 5, 2004

(65) Prior Publication Data

US 2005/0144824 A1 Jul. 7, 2005

(51) Int. Cl.
*G09F 15/00* (2006.01)

(52) U.S. Cl. ..... 40/606.18; 40/781

(58) Field of Classification Search ..... 40/606.18, 40/781, 611.06, 741, 798
See application file for complete search history.

(56) References Cited

U.S. PATENT DOCUMENTS 1,880,828 A * 10/1932 Courtenay ..... 40/611.05
3,371,439 A * 3/1968 Smith et al. ..... 40/735
5,088,221 A * 2/1992 Bussiere et al. ..... 40/618
5,134,794 A * 8/1992 Walrath ..... 70/781
5,987,794 A * 11/1999 Lavi et al. ..... 40/611.04
6,865,836 B2 * 3/2005 Sachs-Lavery ..... 40/741
2004/0128894 A1 * 7/2004 Sachs-Lavery ..... 40/741

* cited by examiner

*Primary Examiner*—Joanne Silbermann
(74) *Attorney, Agent, or Firm*—Diller, Ramik & Wight

(57) ABSTRACT

A modular pedestal sign or suspended sign is formed as a hollow border defined by upper, lower and opposite side hollow members collectively setting-off an inboard signage area. The upper and lower hollow members are preferably each formed by identically hollow bodies which are snap-secured together and each also defines a pair of projecting legs which are in internal telescopic relationship to the hollow side members. A polymeric/copolymeric synthetic thermoplastic foam material is in situ molded in intimate relationship to interior surfaces of the border to rigidify the assembled components, though snap fasteners may be utilized. Additional signage areas can be formed utilizing hollow divider members having oppositely directed pairs of legs.

8 Claims, 11 Drawing Sheets

MODULAR PEDESTAL AND SUSPENDED SIGNS

BACKGROUND OF THE INVENTION

The invention is directed to pedestal signs and hanging or suspension signs which are utilized particularly at on-site and entrance locations for professional offices, restaurants, real estate development, sales locations, retail stores, home sales, bed and breakfast homes, historical sites and the like. Heretofore such signs have been manufactured with little concern for low cost manufacture, ease of assembly, convertibility, expandability, long life, etc.

SUMMARY OF THE INVENTION

The invention is directed to a durable modular sign system constructed with incredible detail and architectural flare from modern synthetic polymeric/copolymeric materials which are formulated to reduce deterioration from harmful ultraviolet rays, resist the accumulation of dust and dirt, are made from injected-molded and/or extruded hollow members of precise fit and finish, and include exchangeable or interchangeable components to increase or decrease signage areas and effect installations as either hanging or pedestal signs.

In accordance with the present invention a "base" sign is preferably constructed as a substantially hollow polygonal border defined by upper, lower and opposite side members defining therebetween a substantially polygonal "main" signage area. The side members are tubes extruded from synthetic polymeric/copolymeric plastic material while the upper and lower members are each formed from two identical bodies of injection molded synthetic polymeric/copolymeric plastic material which, when placed in opposing relationship to each other, define the upper and lower hollow members. The upper and lower hollow members preferably include pairs of respectively downwardly and upwardly projecting hollow legs which are telescopically inserted into respective upper and lower ends of the hollow side members thereby completing the overall size and configuration of the sign.

The sign just described is rigidified prior to assembly by injecting urethane foam into the upper and lower hollow members which cures, solidifies and bonds intimately against all interior surfaces. Prior to the injection of the urethane foam or equivalent synthetic foam material into the upper and lower hollow members, upper and lower pairs of bodies each defining the upper and lower hollow members are snapped-fastened together to assure alignment accuracy during the injection and curing of the foam material which, upon solidification, not only maintains the upper and lower hollow members securely assembled, but provides superior strength, rigidity and durability.

The pairs of bodies of the upper hollow members are of a substantially identical construction, as are the pairs of bodies of the lower hollow members, and preferably each body is manufactured by injection molding with both male and female fasteners and locating openings formed as integral portions thereof. When placed in peripherally aligned opposing relationship, each pair of bodies are readily and easily located and snap-secured with respect to each other.

The "basic" sign of the invention may also include one or more hollow divider members, each formed of two identical bodies, which when assembled define a hollow chamber with each hollow divider member also including an upwardly directed pair of projecting legs and a lower pair of projecting legs which can be utilized in association with the "basic" sign and its "main" signage area and two shorter hollow side members to add a "secondary" smaller signage area to the "basic" sign below the "main" signage area. Other such additional hollow divider members offer further expansion of the "basic" sign to include several signage areas. Typically, such an "expanded" modular sign of the present invention might include a relatively large uppermost "main" signage area of substantially 24"×18" bordering a main display panel which might include, for example, the name of a law firm, such DILLER, RAMIK & WIGHT, while the next immediately lower signage area might be 24"×6" and have thereon the name of an attorney, such as Vincent L. Ramik. A next immediately lower signage area may similarly be of a 24"×6" size and include one or more further legal associates of the firm, such as Sandy LeBrun-Evans. Obviously, such a modular sign can be expanded or contracted as circumstances dictate.

In further accordance with this invention the "basic" sign is preferably suspended or hung, but in lieu thereof, its lower member may include a pedestal and/or base for ground support. When constructed as a hanging or suspended sign, relatively long eye-bolts or chains each having an eye at one end and a thread portion at an opposite end can be assembled telescopically internally of each hollow side member with each eye and thread portion projecting outwardly of the respective upper and lower members which respectively function as hanging points and connecting points for washers and threaded nuts to retain the modular components or members assembled.

With the above and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENTS

Figure 1:
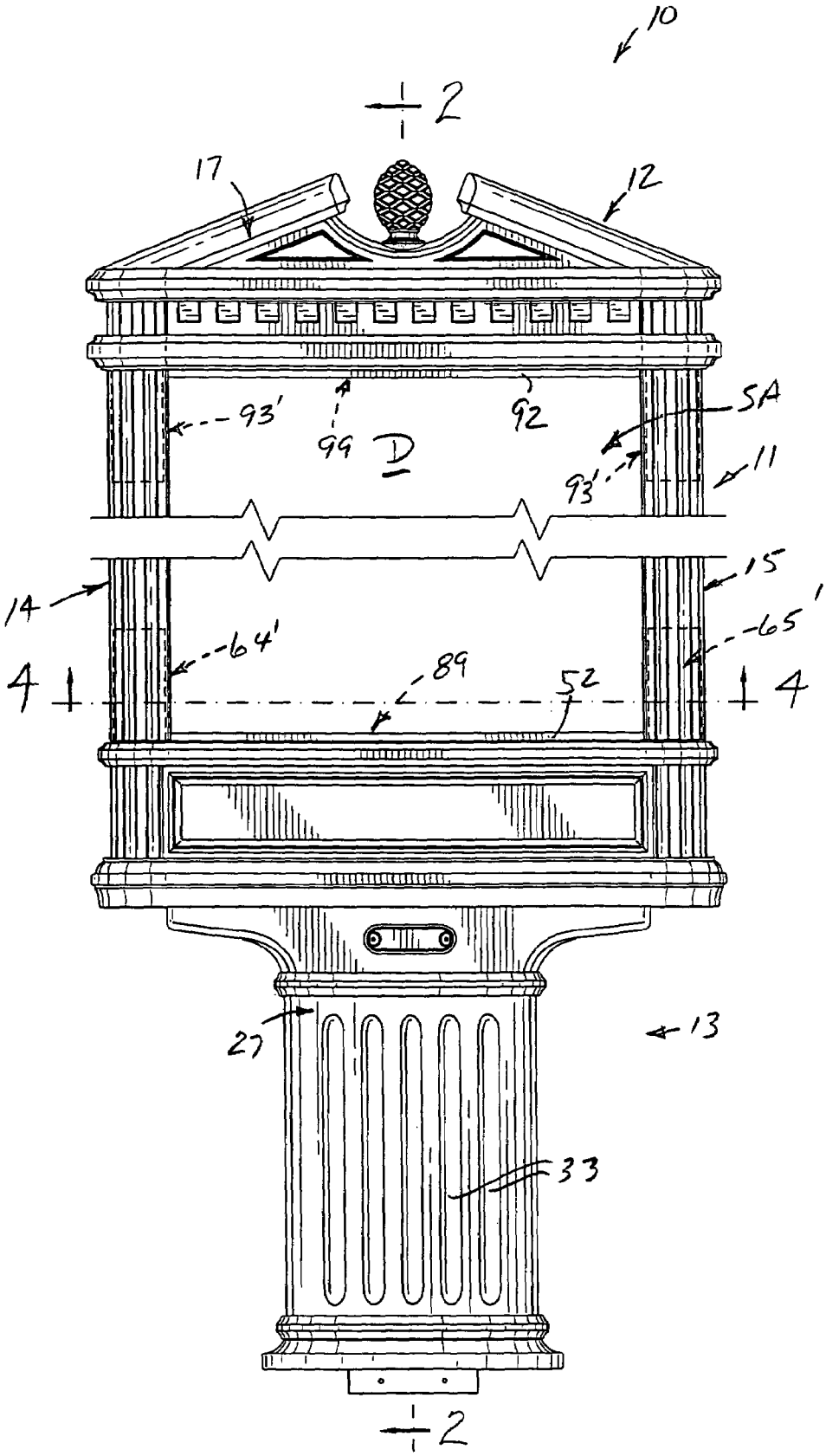
FIG. 1 is a fragmentary front elevational view of a novel modular sign constructed in accordance with the invention, and illustrates a hollow border defined by upper, lower and opposite side hollow members setting-off an inboard substantially polygonal signage area with the upper and lower hollow members each having a pair of respectively downwardly and upwardly projecting legs located in internal telescopic relationship to respective upper and lower ends of the hollow side members.
Figure 2:
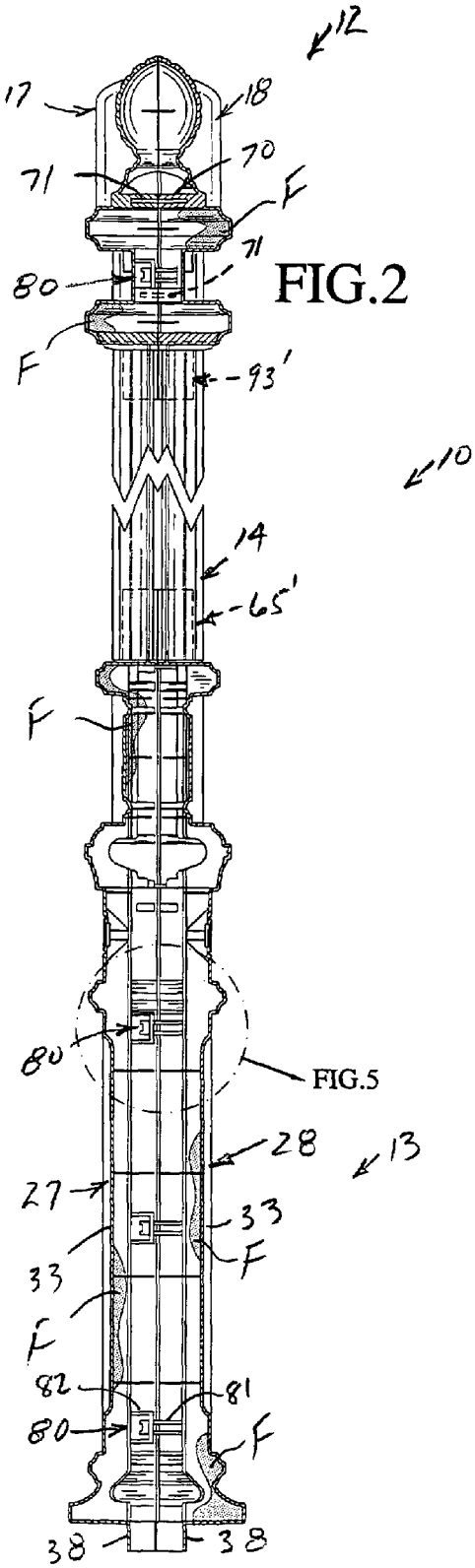
FIG. 2 is a vertical cross-sectional view taken generally along line 2—2 of FIG. 1, and illustrates details of the hollow members and feet, snap fasteners securing identical pairs of bodies defining the hollow upper and lower members to each other, and the interior of the hollow upper and lower members filled with rigid foam plastic material.

A novel modular sign constructed in accordance with this invention is illustrated in FIGS. 1 through 4 and 7 of the drawings, and is generally designated by the reference numeral 10.

The sign 10 (FIGS. 1 through 4 and 7) includes a substantially hollow border 11 (FIG. 1) defined or set-off by a substantially hollow upper member or cap 12, a substantially hollow lower member or cap 13 and a pair of substantially identical opposite hollow side members, tubes or columns 14, 15.

The hollow upper member 12 is made of two substantially identical hollow body members 17, 18 each of a substantially identical construction and peripheral configuration.

The hollow lower member 13 is constructed of two substantially identical hollow bodies 27, 28 (FIGS. 3 and 7) which are also of a substantially identical peripheral outline or profile.

Figure 8:
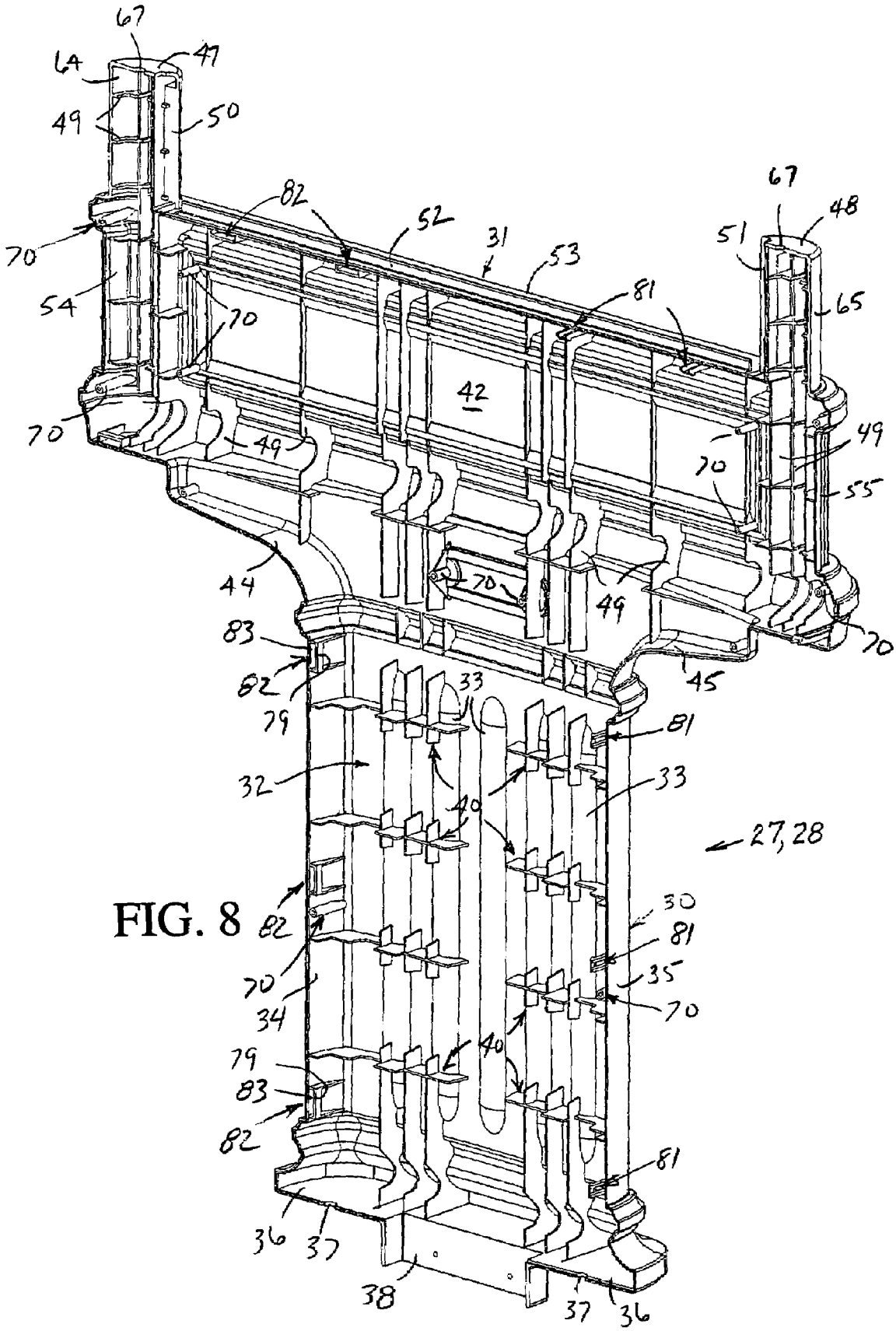
FIG. 8 is an enlarged perspective view of one of the two identical lower member bodies which collectively define the hollow lower member, and illustrates the positions of locating holes and male and female snap fasteners which respectively readily locate and snap-secure the bodies together to form the hollow lower member.

One of the hollow bodies 27, 28 of the hollow lower member 13 is best illustrated in FIG. 8 of the drawing, and each hollow body 27, 28 is generally of an upstanding T-shaped configuration formed by a substantially vertical pedestal wall 30 and a substantially horizontal cross arm wall 31. The pedestal wall 30 includes a main wall 32 of a generally polygonal configuration having a plurality of vertically extending and transversely spaced substantially parallel rigidifying ribs/grooves 33. Pedestal side walls 34, 35 (FIG. 8) are substantially normal to the main wall 32 and extending therebetween is a base wall 36 having slots or notches 37, 37 (FIG. 8) and a downwardly directed U-shaped flange 38. A plurality of inboard groups 40 of intersecting vertical and horizontal reinforcing ribs impart rigidity to the main wall 32 and the pedestal side walls 34, 35, as is readily apparent from FIG. 8 of the drawings. The pedestal side walls 34, 35 blend with respective lower peripheral walls 44, 45 projecting substantially normally from a substantially polygonal or rectangular main wall 42 of the cross arm wall 31. The lower peripheral walls 44, 45 blend with respective peripheral side walls 54, 55 of the cross arm 31 which in turn blend with and in part define semi-cylindrical walls 64, 65, respectively, each having a slot or notch 67 in an end wall 47, 48 thereof. Walls 50, 51 project from the walls 64, 65, respectively, and blend with an upwardly directed wall 52 of an upper peripheral wall 53. A plurality of individual and groups of vertical and horizontal reinforcing ribs, generally designated by the reference numeral 49, are located throughout the cross arm wall 31 for reinforcement purposes.

Figure 3:
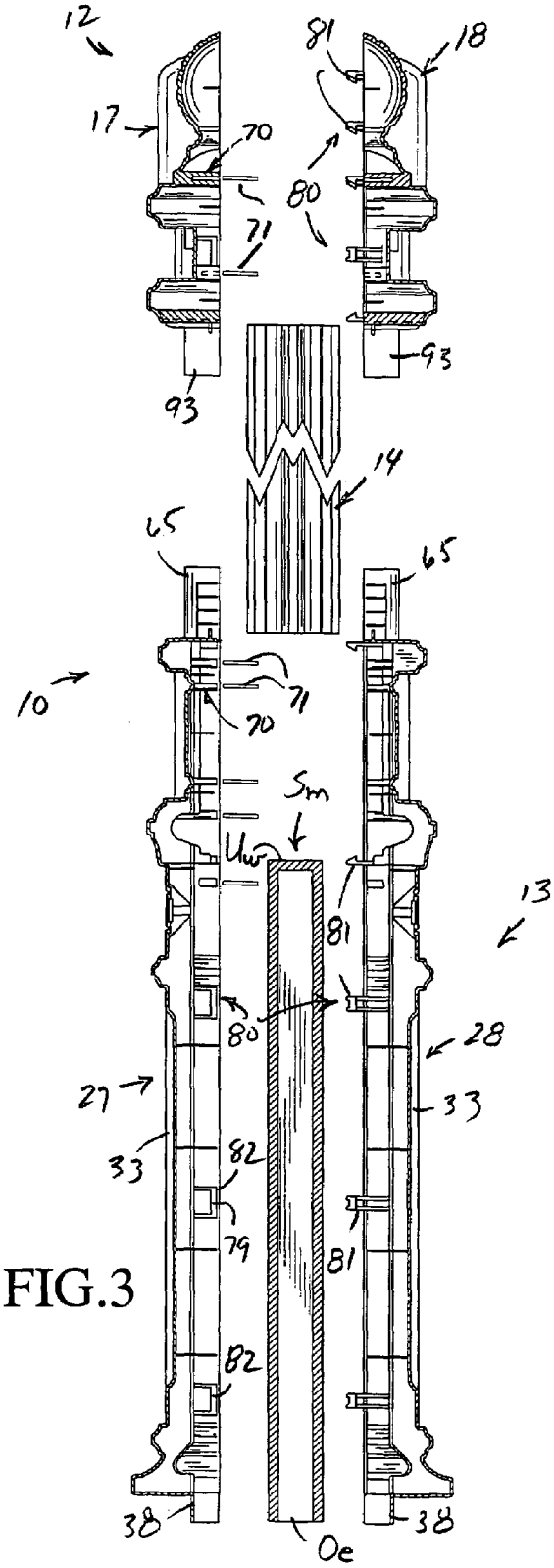
FIG. 3 is a fragmentary exploded cross-sectional view similar to FIG. 2, and illustrates the pairs of upper and lower bodies prior to being snap-assembled to each other to define the upper and lower hollow members, respectively.
Figure 4:
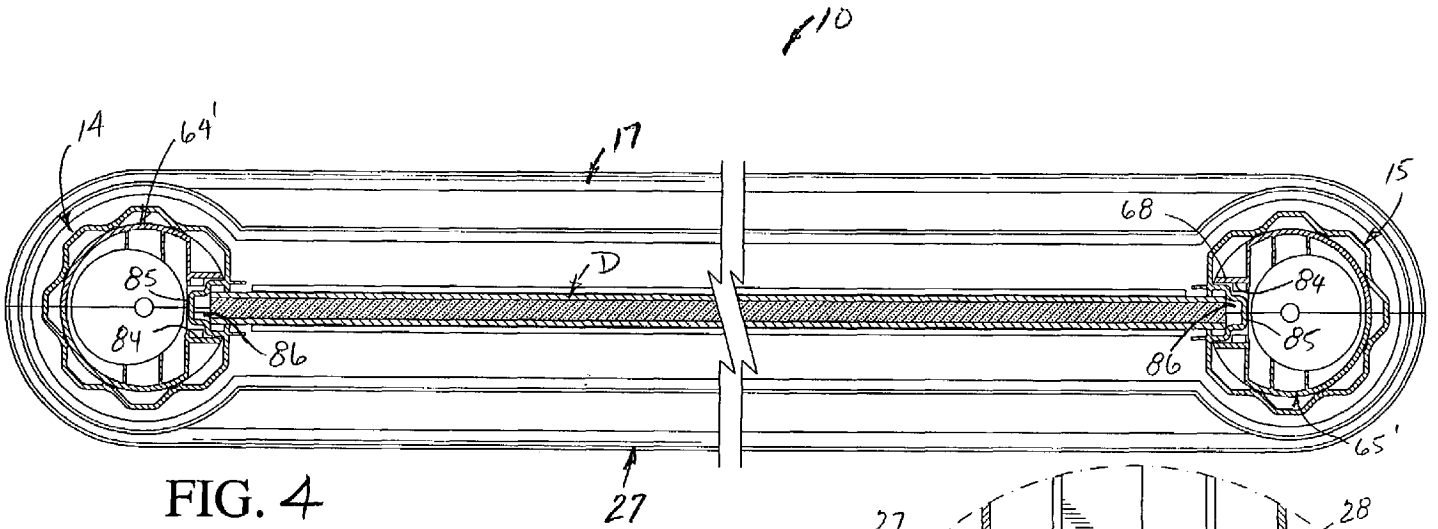
FIG. 4 is an enlarged cross-sectional view taken generally along line 4—4 of FIG. 1, and illustrates the upwardly projecting pair of feet of the lower hollow member telescopically received in lower ends of the hollow side members and the latter having opposing channels between which is housed a display panel.

A plurality of locating means 70 in the form of cylindrical openings are formed in the pedestal wall 30 and the cross arm 31 and open in opposing relationship to each other when the hollow lower pedestal bodies 27, 28 are positioned in opposing mating relationship to each other, as is most evident from FIG. 3 of the drawings. Locating pins 71 are positioned in the locating openings 70 to accurately mate the lower pedestal bodies 27, 28 in edge-to-edge peripheral alignment during assembly of the hollow lower member or pedestal 13 of the sign 10, as will be more apparent hereinafter.

Figure 5:
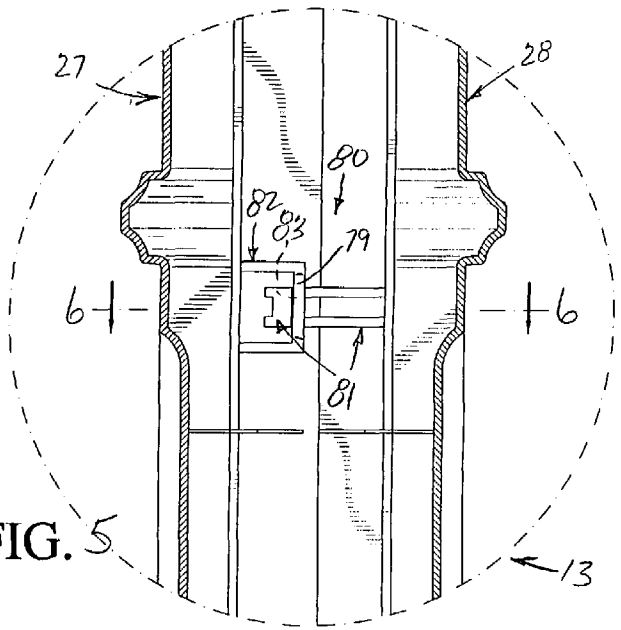
FIG. 5 is an enlarged cross-sectional view of the encircled portion of FIG. 2, and illustrates a pair of snap fasteners of the pair of lower hollow bodies defined by male and female fasteners in snap-secured relationship to each other.
Figure 6:
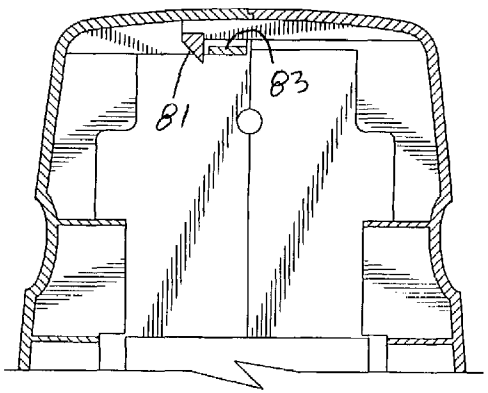
FIG. 6 is an enlarged cross-sectional view taken generally along line 6—6 of FIG. 5, and more clearly illustrates the snap-securement of the male and female snap fasteners.
Figure 7:
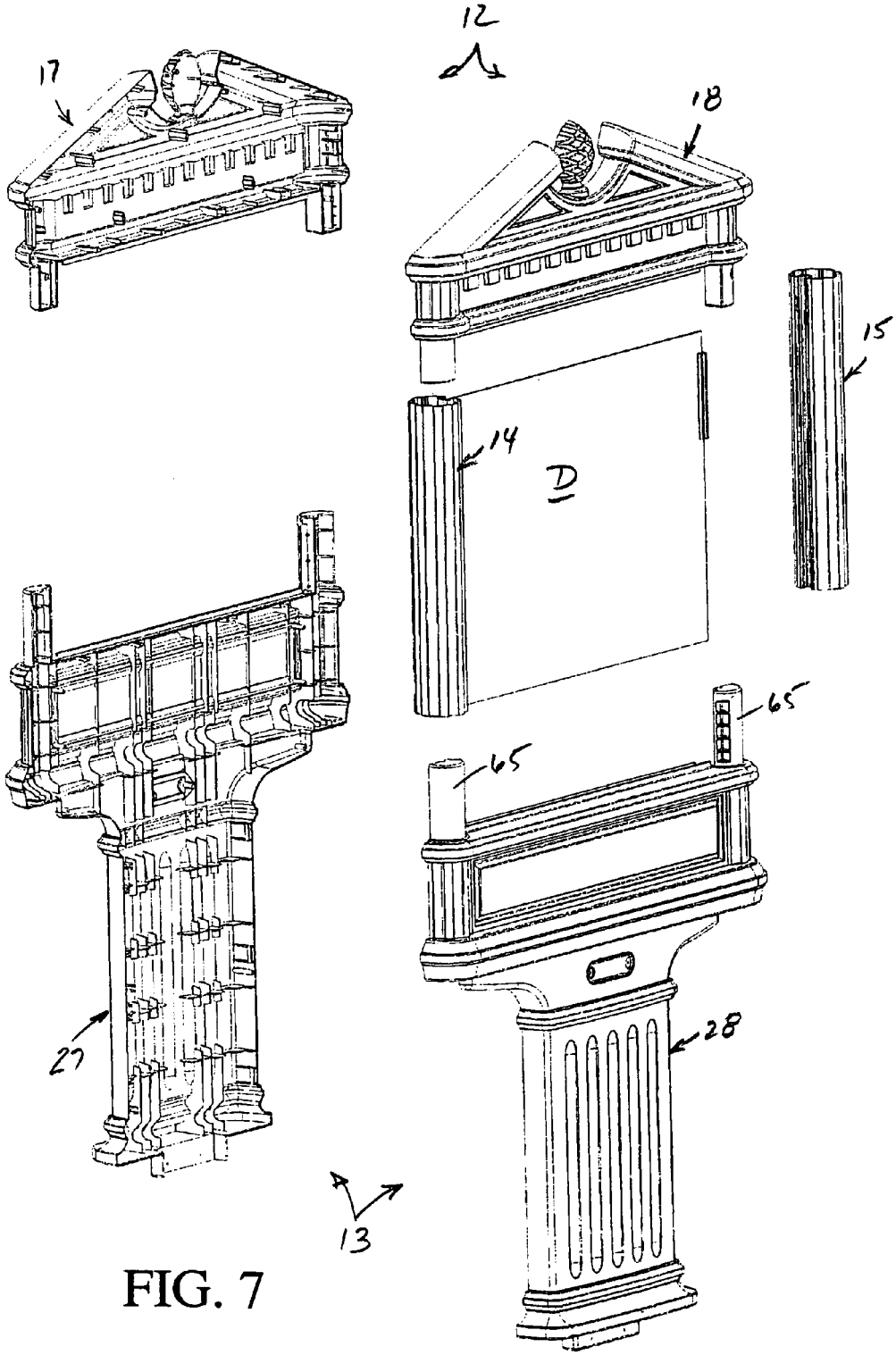
FIG. 7 is an exploded perspective view of the components of the sign of FIG. 1 prior to the assembly thereof, and illustrates the substantially identical construction of the pair of bodies of the upper hollow member, the substantially identical construction of the pair of bodies of the lower hollow member and the two substantially identical hollow side members.

Each of the hollow bodies 27, 28 of the hollow lower member 13 includes means in the form of cooperative snap fasteners generally designated by the reference numeral 80 defined by male snap fasteners or tongues 81 (FIGS. 3, 5, 6 and 8) and female snap receptors 82 each in the form of an opening 83 (FIGS. 5 and 6) in part defined by a latching bar 79. The male snap fasteners 81 and the female snap receptors 82 are located relative to the hollow bodies 27, 28 such that upon the hollow bodies 27, 28 being assembled into peripheral edge-to-edge engagement, a male snap fastener 81 of one hollow body 27, 28 will telescopically enter an opening 83 of a female snap receptor 82 and engage behind the latching bar 79 of the other hollow body 27, 28, as is readily apparent from the location of the snap fasteners and receptors 81, 82, respectively, illustrated in FIG. 8 of the drawings. Thus, upon locating the locating pins 71 (FIG. 3) in and relative to the locating openings or bores 70 and moving the hollow lower bodies 27, 28 toward each other from the position shown in FIG. 3 to the position shown in FIG. 2, the two hollow lower bodies 27, 28 will be accurately located by the locating means 70, 71 and snap-secured to each other by the snap-securing means 80, namely, the snap securement between the male snaps, tongues or fasteners 81 and the female snap openings 83 and latching bars 79 of the female snap receptors 82. When so assembled, each pair of opposing semi-cylindrical walls 64, 64; 65, 65 define upwardly projecting cylindrical legs 64', 65' (FIGS. 1 and 4) which project upwardly interiorly in telescopic relationship to open lower ends (unnumbered) of the hollow side members, tubes or columns 14, 15. The opposing wall portions 50, 51 (FIG. 8) projecting in opposing relationship from the semi-cylindrical walls 64, 65, respectively, collectively define opposing vertically extending channels 84, 84 (FIG. 4) which open toward each other and receive in registry therewith vertically extending inwardly directed ribs 85, 85 of each of the hollow side members 14, 15. The inwardly projecting ribs 85, 85 of each of the hollow side members 14, 15 extend the complete vertical length thereof and each defines a display panel retaining channel 86 (FIG. 4) with the channels 86, 86 extending the full length of each hollow side member 14, 15. After the lower ends of the hollow side members 14, 15 have been slipped downwardly upon the upwardly projecting legs 64', 65' of the hollow lower member 13, a display panel D of a size (24"×18") corresponding substantially to a first or major signage area SA of the hollow border 11 can be slid downwardly from above into the retaining channels or slots 86, 86 (FIG. 4) prior to the assembly of the hollow upper member 12 to the hollow side members 14, 15, as will appear hereinafter. A lower edge (unnumbered) of the display panel D also seats in a lower upwardly opening retaining channel 89 defined between the opposing walls 52, 52 of the cross arms 31, 31 of the pedestal bodies 27, 28.

Figure 9:
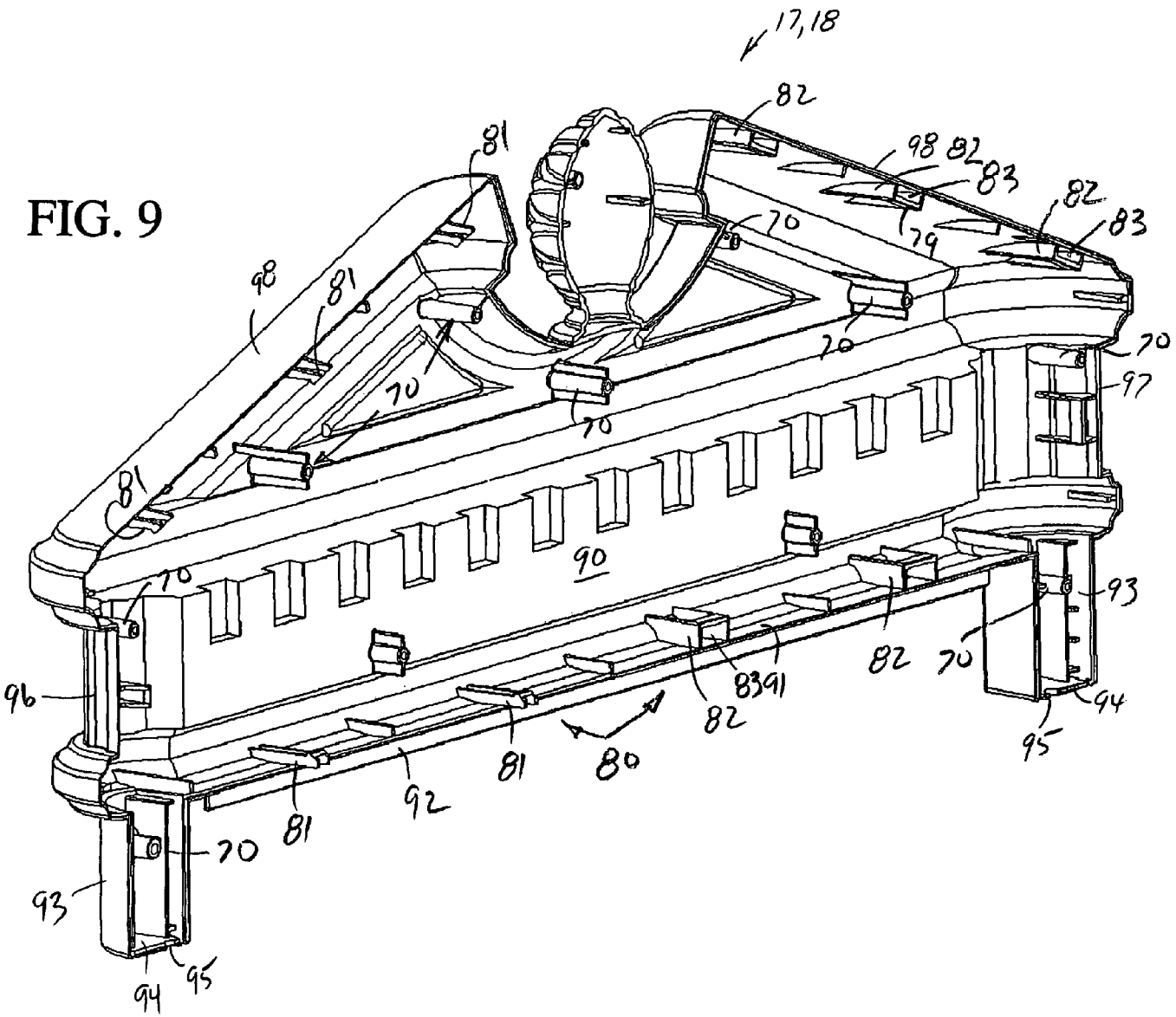
FIG. 9 is a perspective view of one of the two identical upper bodies which collectively define the hollow upper member, and illustrates a plurality of locating holes and male and female snap fasteners for respectively locating and snap-securing the pair of upper bodies to each other incident to forming the hollow upper member.

Reference is specifically made to FIG. 9 of the drawings and one of the two identical hollow body members 17, 18 of the upper hollow member or cap 12 which is formed of a single piece of injection molded synthetic polymeric/copolymeric material and includes a main wall 90 which blends with a lower peripheral wall 91 substantially normal thereto and which in turn includes a downwardly directed relatively shallow wall 92. The lower or bottom wall 91 merges at each end with an identical semi-cylindrical wall 93 closed by a bottom wall 94 having a slot or notch 95 formed therein. The semi-cylindrical walls 93 blend with opposite side walls 96, 97 which in turn blend with an upper ornate peripheral wall 98. As in the case of the hollow bodies 27, 28 of the hollow lower member 13, the hollow bodies 17, 18 of the upper hollow member 12 include locating means 70 in the form of cylindrical locating bores or openings and snap-securing means 80 in the form of male snap fasteners 81 and female snap fastener receptors 82 having openings 83 and latching bars 79. As is most readily apparent from FIGS. 7 and 9, when the hollow mold bodies 17, 18 are peripherally aligned in edge-to-edge opposing relationship and are moved toward and into edge-to-edge contact, pins 71 (FIG. 2) associated therewith progressively enter the locating bores 70 to align and maintain alignment between the hollow bodies 17, 18 until each of the male snap-fasteners 81 is snap-secured to the latching bars 79 of the female snap receptors 82. When so assembled, the opposing semi-cylindrical walls 93, 93 each define a downwardly projecting cylindrical leg 93' (FIGS. 1 and 2) which is telescoped internally into the upper ends (unnumbered) of the hollow side members or columns 14, 15. The downwardly projecting spaced ribs 92, 92 (FIG. 9) define a downwardly opening channel 99 (FIG. 1) which receives an upper edge (unnumbered) of the display panel (D), as is most evident from FIG. 1.

The sign 10 is essentially manufactured from six components, namely, the injection molded bodies 17, 18, 27 and 28 (FIG. 7) and the two preferably extruded hollow side members or columns 14, 15. After the bodies 17, 18 and 27, 28 have been snap-secured together through the utilization of the snap-fastening means 80 augmented by the locating means 70 and the pins 71 associated therewith, each assembled hollow member 12 is placed in a mold cavity generally corresponding in profile to that of the hollow upper member 12. Thereafter, a conventional polyurethane foam system is utilized to inject urethane foam F into holes defined by the slots 95, 95 or, alternatively, the wall 98 of each hollow upper member 17, 18 can be drilled and the holes utilized for foam injection. The polyurethane foam enters the chamber (unnumbered) of the upper hollow member 12 and during curing substantially fills the same and adheres intimately to interior surfaces thereby forming a substantially rigid unit. The characteristics of such rigid thermosetting plastic foams and others which can be used in accordance with this invention can be found in the Canadian Building Digest published by the Institute for Research in Construction of the National Research Counsel Canada, Building M-24, 1500 Montreal Road, Ottawa, Ontario K1A 0R6. A conventional foaming system is disclosed by Preferred Foam Products of RT #81, 140 Killingworth Turnnike, P.O. Box 942, Clinton, Conn. 06413.

The bodies 27, 28 are similarly snap-fastened together, located in the cavity of a correspondingly profiled mold, and the interior of the lower hollow member 13 is similarly injected with urethane foam, again resulting in a relatively rigid structure. There is, however, one difference between injecting the urethane foam into the interior of the hollow member 13, as compared to the hollow member 12, namely, a substantially polygonal molding sleeve Sm (FIG. 3) having a closed upper wall Uw and an open end Oe is inserted between the hollow bodies 27, 28 prior to being snap-secured together or is slid therein through the opening (unnumbered) formed by the flanges 38, 38 (FIG. 8) after the hollow member 13 is snap-secured together.

During the injection of the urethane foam through the openings 37, 37, the molding sleeve Sm prevents the foam F from entering the area defined by the molding sleeve Sm. The molding sleeve Sm is interiorly dimensioned slightly larger than 2"×6"×24", and when the molding sleeve Sm is removed from the hollow lower member 13, after the urethane foam has cured, a like sized chamber is formed by the foam into which a pressure treated 2"×6" post can be inserted with the opposite end being insertible into the ground.

The hollow side members or columns 14, 15 preferably are not filled with urethane foam because these are rigidified by the legs 64', 65' and 93' telescoped internally therein (FIG. 1). However, central areas of the hollow columns 14, 15 can be filled with urethane foam so long as the upper and lower ends of each of the hollow columns 14, 15 are left open for receipt of and frictional gripping engagement with the legs 64', 65' and 93'.

In order to set-up the sign 10, the lower ends of the hollow columns 14, 15 are exteriorly telescoped downwardly upon and into frictional binding engagement with the upwardly projecting legs 64', 65' of the hollow lower member 13. The display panel D can then be slid downwardly through the opposing side channels 86, 86 (FIG. 4) until a lower end (unnumbered) of the display panel D enters the upwardly opening channel or slot 89 (FIG. 1) of the hollow lower member 13. Thereafter the legs 93', 93' of the upper hollow member 12 are progressively inserted into the upper ends (unnumbered) of the hollow columns 14, 15 which are held together by the friction fit therebetween. When finally assembled, the upper edge of the display panel D is housed in the downwardly opening channel 99 (FIG. 1) of the upper member 12 and, of course, the latter can be removed at any time the display D is changed.

Figure 10:
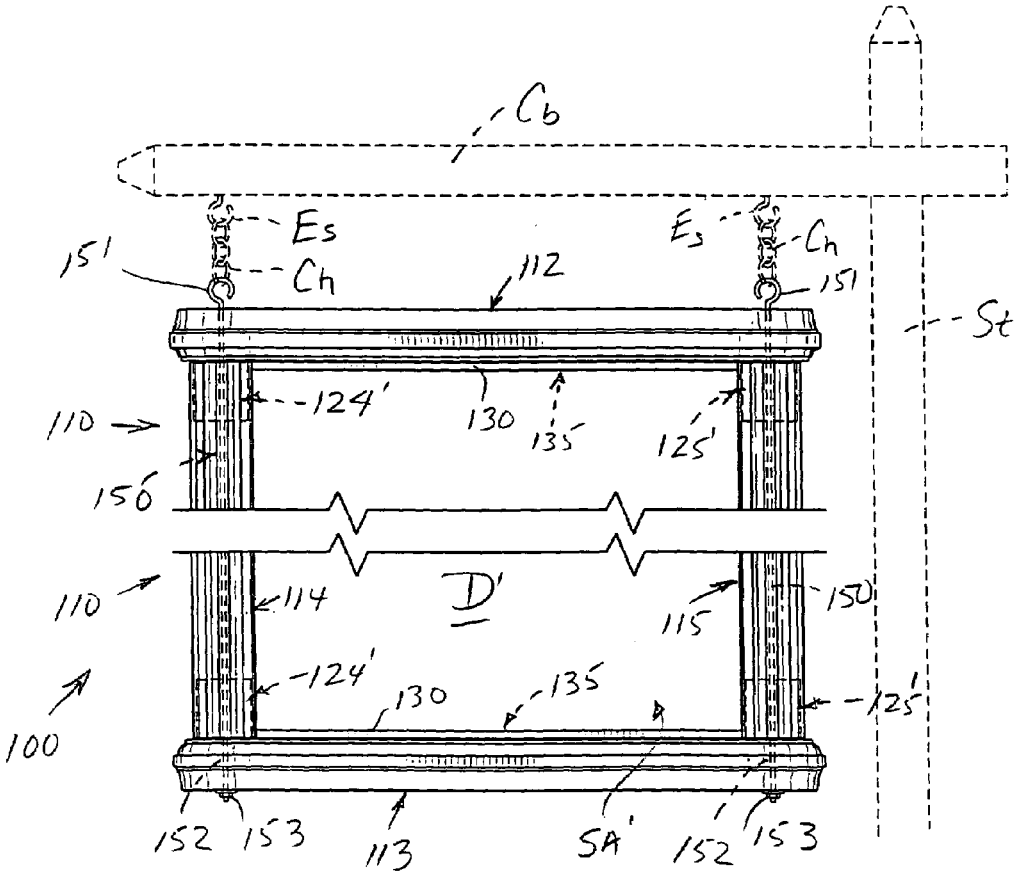
FIG. 10 is a fragmentary front elevational view of another novel modular hanging or suspension sign constructed in accordance with this invention, and illustrates a hollow border defined by upper, lower and opposite side hollow members setting-off an inward substantially polygonal signage area with the upper and lower hollow members each having a pair of respectively downwardly and upwardly projecting legs located in internal telescopic relationship to respective upper and lower ends of the hollow side members, and elongated eye-bolts for unitizing the sign and hanging the same from a standard illustrated in phantom outline.

Another novel modular sign constructed in accordance with this invention is illustrated in FIG. 10 of the drawings and is generally designated by the reference numeral 100. As compared to the modular sign 10 which is a pedestal sign, the sign 100 is a suspension or hanging sign which hangs by conventional chains Ch hooked in eyes or eyelets Es in a substantially horizontal cross bar Cb of a stand St suitably supported in the ground or a similar supporting surface.

The sign 100 includes a substantially hollow border 110 (FIG. 10) defined or set-off by a substantially hollow upper member or cap 112, a substantially hollow lower member or cap 113 and a pair of substantially identical opposite hollow side members, tubes or columns 114, 115.

The hollow columns or tubes 114, 115 are identical to the respective hollow columns or tubes 14, 15 of the sign 10.

Figure 11:
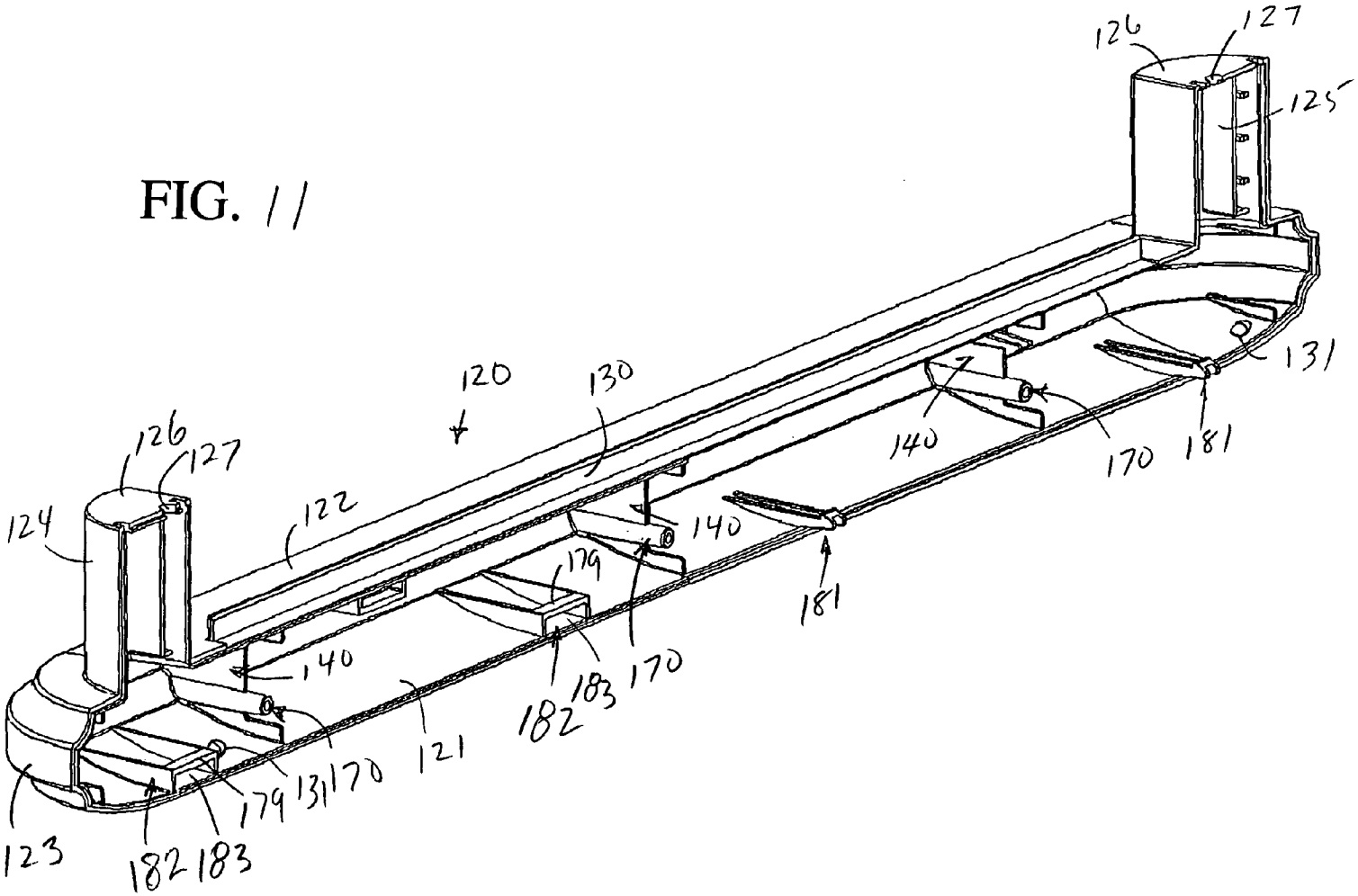
FIG. 11 is a perspective view of one of two identical bodies which when assembled in pairs collectively define each of the hollow upper and lower members, and illustrates a plurality of locating holes and male and female snap fasteners for respectively locating and snap-securing the pair of upper and lower bodies to each other incident to forming the respective upper and lower hollow members.

The upper and lower hollow members 112, 113 are also identical to each other and each hollow upper and lower member 112, 113 is formed of two identical substantially hollow bodies 120 with one such hollow body 120 being illustrated in FIG. 11 of the drawings.

The hollow body 120 is preferably made from injection molded synthetic polymeric/copolymeric plastic material.

Each hollow body 120 includes a lower wall 121, an upper wall 122 and a stepped peripheral wall 123 located between the walls 121, 122. The upper wall 122 merges with a semi-cylindrical wall portion 124, 125 at opposite ends of the upper wall 122 and each semi-cylindrical wall portion 124, 125 ends in an end wall 126 having a notch or opening 127. A wall 130 is substantially normal to the upper wall 122, and when two such hollow bodies 120, 120 are assembled to form the upper and lower hollow members 112, 113, respectively, the opposing walls 130, 130 define opposing channels 135, 135 (FIG. 10) corresponding to the channels 89, 99 of the sign 10 (FIG. 1).

The bodies 120 also include locating means 170 (FIG. 11) associated with locating pins (not shown) and snap-securing means 180 corresponding identically to the respective locating means 70 and snap-securing means 80 of the sign 10. Appropriate reinforcing means 140 corresponding in structure and function to the reinforcing means 40, 49 of the sign 10 lend rigidity to the hollow bodies 120.

Two of the hollow bodies 120, 120 are aligned and snap-secured together in the manner heretofore described with respect to the hollow upper and lower members 12, 13, respectively, of the sign 10. The semi-cylindrical walls 124, 124, and 125, 125 of the pair of the bodies 120, 120 define respective legs 124', 125' (FIG. 10) of the hollow upper and lower members 112, 113, respectively.

As in the case of the sign 10, the hollow members 112, 113 are injected with urethane foam after being placed in an appropriate mold utilizing the openings or holes defined by the opposing slots 127 in the end walls 126. The latter openings in the end walls 126 are preferably axially located and are aligned with drill holes 131 formed in the lower wall 121 at the completion of the curing of the urethane foam.

The legs 124', 125' of the respective upper and lower hollow members 112, 113 are frictionally engaged in internal telescopic relationship to open upper ends of the hollow side members or columns 114, 115. Though the frictional purchase between the legs 124', 125' and the hollow columns 114, 115 would be sufficient to maintain the frame or border 110 assembled if the hollow lower member 113 functioned as a base or pedestal, additional means in the form of an elongated eye bolt or chain 150 having an eye 151 at one end and a threaded end portion 152 at an opposite end is inserted downwardly through the openings 131, 127 and the foam F after which a washer and nut 153 are secured to each threaded end portion 152 (FIG. 10). The latter construction assures that the sign 100 will remain rigidly unified unless, for example, one wished to change a display panel D' thereof which is accomplished substantially in the same manner as that described relative to the display panel D of the sign 10.

Figure 12:
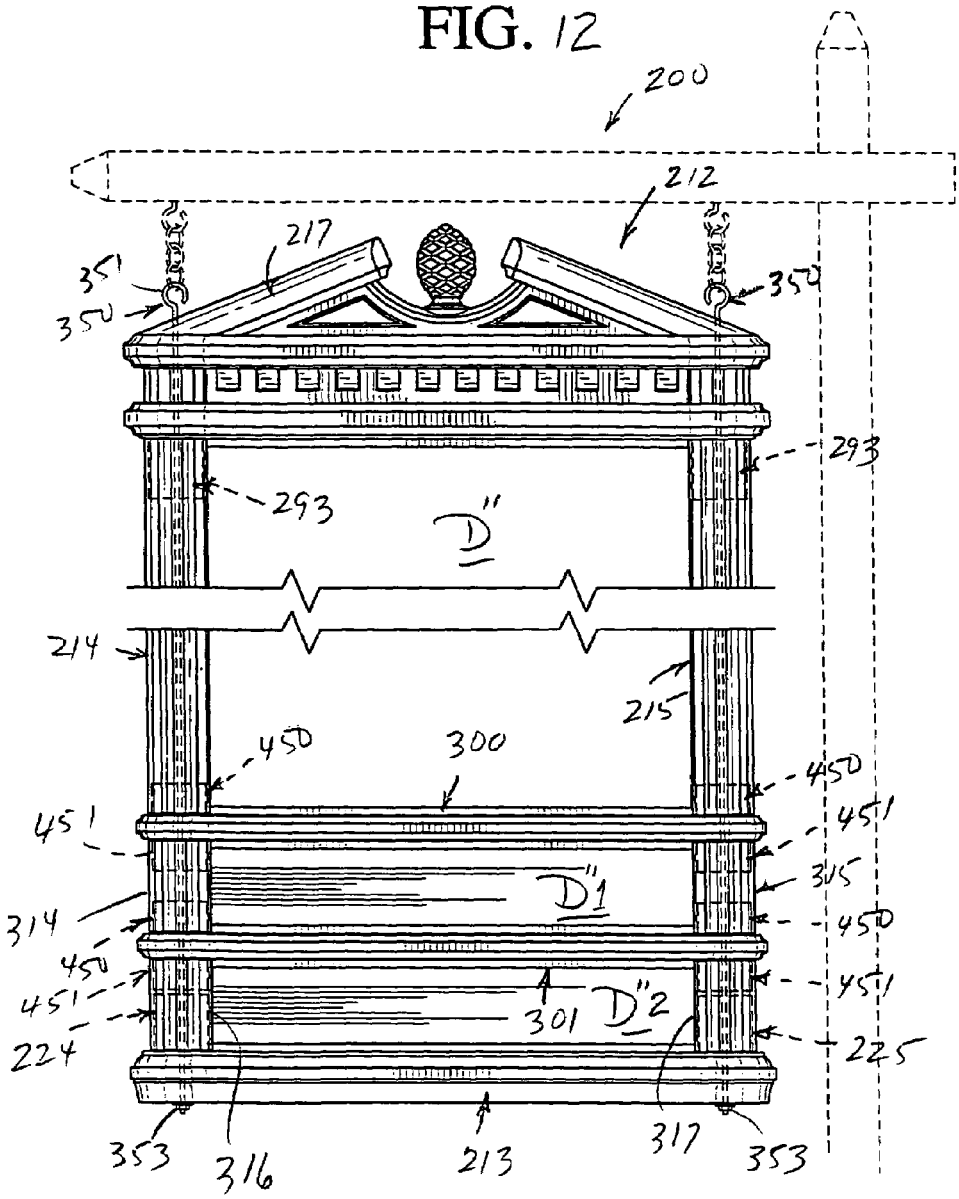
FIG. 12 is a fragmentary front elevational view of a novel modular hanging sign constructed in accordance with the invention, and in addition to a major signage area, the sign includes two hollow divider members which define in part two lower minor signage areas and shorter hollow side members, tubes or columns associated therewith.
Figure 13:
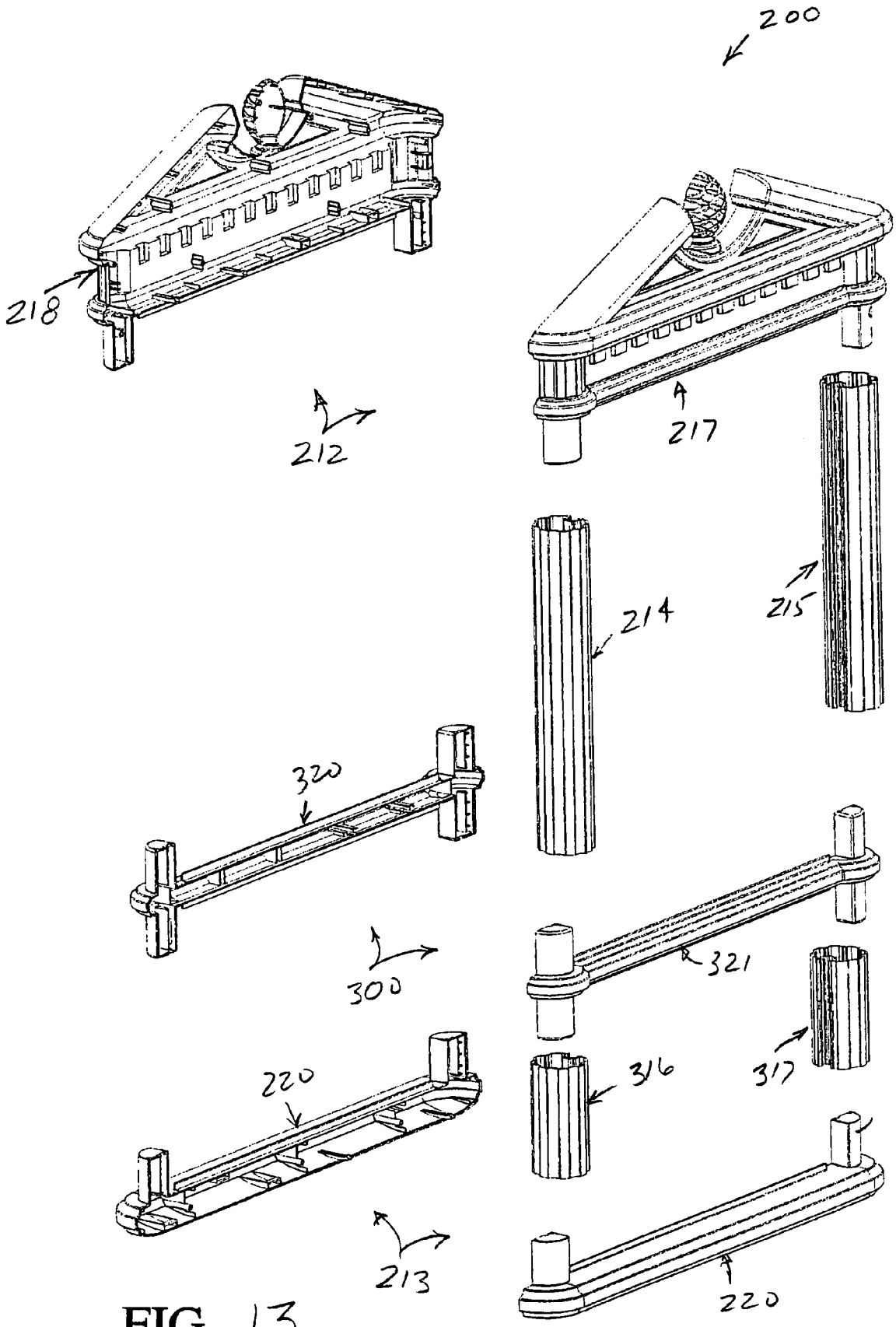
FIG. 13 is an exploded perspective view of the components of the sign of FIG. 12, excluding one of the hollow divider members and a pair of the shorter hollow side members or columns, and illustrates the substantially identical construction of a pair of bodies defining the upper hollow member, the hollow divider member, and the lower hollow member.

Another hanging sign constructed in accordance with this invention which has components identical to those of the signs 10 and 100 bear like reference characters to identify identical components, structures and functions but are preceded by two hundred, such as a sign 200 of FIGS. 12 and 13.

The sign 200 includes a hollow upper member or cap 212 (FIG. 12) defined by a pair of identical bodies 217, 218; a pair of hollow side members, tubes or columns 214, 215; and a hollow lower member or cap 213 having upwardly projecting legs 224, 225.

In addition to the components just named, the sign 200 also includes a pair of identical hollow divider members 300, 301 of which only the divider member 300 is illustrated in FIG. 13, and two pairs of hollow tubular members, tubes or column 314, 315 and 316, 317. As assembled and illustrated in FIG. 12, the sign 200 includes a major signage area housing a display panel D" and therebelow two smaller signage areas confining and retaining display panels D"1 and D"2. The sign 200 is a hanging or suspension sign, corresponding to the sign 100 of FIG. 1, but by replacing the lower hollow member 213 of FIG. 12 with the lower hollow member 13 of the sign 10, the sign 200 could as well be a pedestal sign.

The sign 200 also includes a pair of eye bolts 350 securing components of the sign together through the utilization of eyes 351 and washers and nuts 353.

Figure 14:
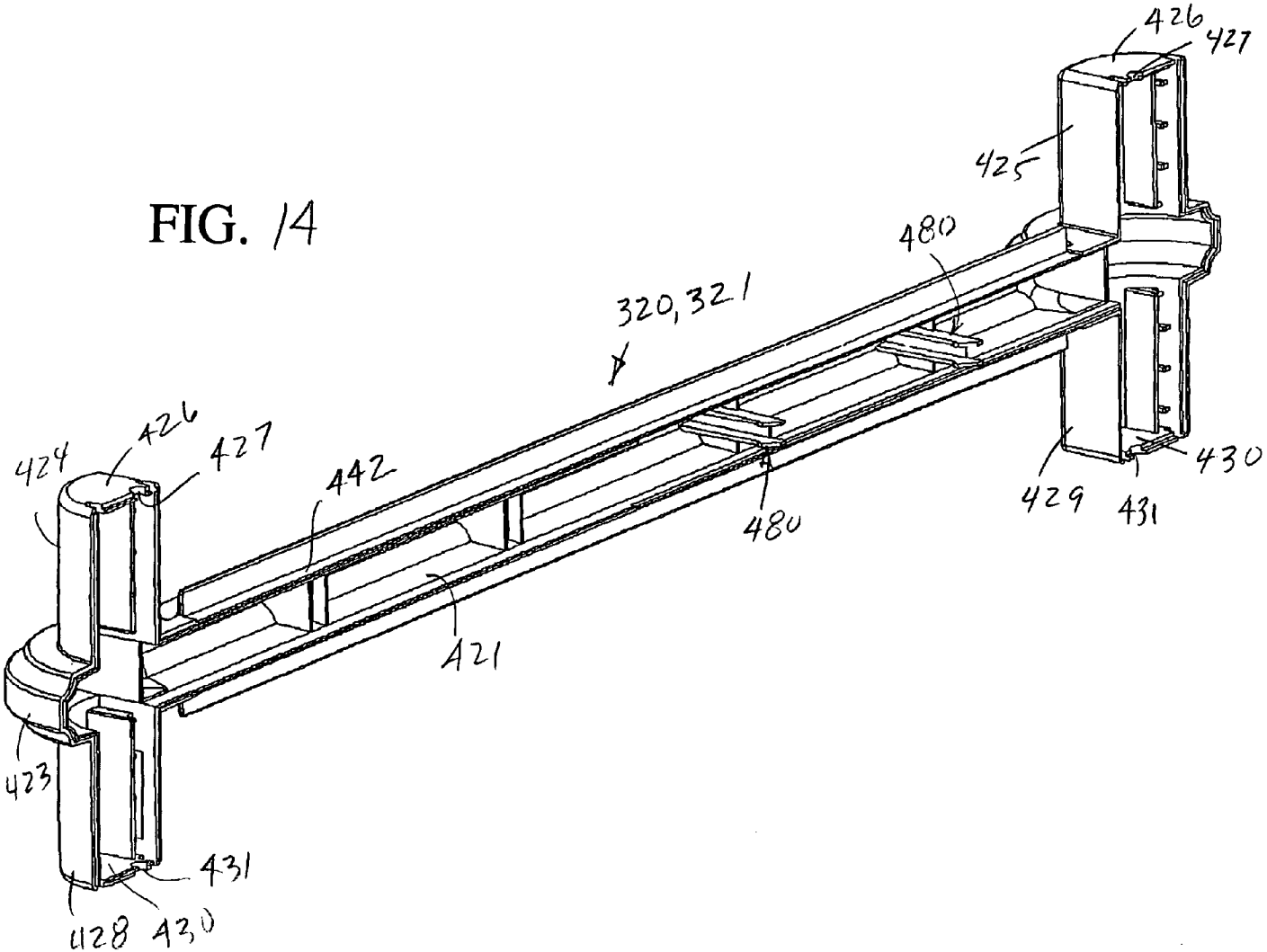
FIG. 14 is a perspective view of one of the two bodies forming the hollow divider member, and illustrates a generally hollow body having pairs of leg-forming semi-cylindrical wall portions projecting upwardly and downwardly.

Reference is made to FIGS. 13 and 14 of the drawings and identical hollow divider bodies 320, 321 of the hollow divider member 300, as well as like hollow bodies 320, 321 forming the hollow divider member 301.

Each body 320, 321 is identical, and as best illustrated in FIG. 14, includes a lower wall 421, an upper wall 422 and a peripheral wall 423 spanning the walls 421, 422 and at opposite ends thereof having semi-cylindrical wall portions 424, 425 projecting upwardly and ending in an end wall 426 having slots or notches 427. Similarly downwardly projecting semi-cylindrical walls 428, 429 terminate in end walls 430 each having an outwardly opening notch or slot 431. Each hollow body 320, 321 includes snap-fastening means 480 and locating means (not shown) corresponding to the respective snap-fastening means 80 and locating means 70, 170 of the signs 10, 100, respectively. Two of the hollow bodies 320, 321 are snap-fastened together in the manner heretofore described and are foam-filled with urethane foam resulting in the relatively rigid divider members 300, 301 (FIG. 12). When thus assembled, the semi-cylindrical wall portions 424, 425 and 428, 430 define respective pairs of upwardly and downwardly projecting legs 450, 450 and 451, 451 of each of the hollow divider members 300, 301 (FIG. 12).

The sign 200 is assembled from the individual components in the manner earlier described with respect to the sign 100 of FIG. 10. The sign 200 is preferably assembled by telescoping the legs 224, 225 of the lower hollow member or cap 213 into the shorter lowermost columns 316, 317 after which the display D"2 can be slid into the retaining channels (unnumbered) of the hollow columns 316, 317 and the lower hollow member 213. Thereafter, the lower pair of legs 451, 451 of the lowermost hollow divider member 301 are inserted into the upper open ends (unnumbered) of the shorter hollow columns 316, 317. Thereafter, the hollow columns 314, 315 are telescoped upon the legs 450, 450 of the lowermost hollow divider member 301, the display panel D"1 is slid into place, the legs 451, 451 of the divider column 300 are telescoped into the upper ends (unnumbered) of the hollow columns 314, 315, etc., to complete the assembly of the sign 200. Thus, by utilizing one or more horizontal hollow divider members 300, 301, etc., the display area of the "basic" hanging sign 100 of FIG. 10 can be expanded beyond the major signage area SA' and the large display panel D' to additional smaller or minor display panels, such as the display panels D"1, D"2, etc. Therefore, changing, adding or subtracting display panels as needed for virtually any purpose whatsoever is readily accomplished due to the identical construction and interchangeability of many of the components of each of the signs heretofore described.

Although a preferred embodiment of the invention has been specifically illustrated and described herein, it is to be understood that minor variations may be made in the apparatus without departing from the spirit and scope of the invention, as defined by the appended claims.

What is claimed is:

1. A sign comprising a substantially hollow border defined by upper, lower and opposite side substantially hollow members, said substantially hollow border setting-off an inboard signage area, at least one of said upper and lower hollow members being made of two substantially similar peripherally contoured bodies disposed in substantially mating opposing relationship and defining therebetween a substantially hollow chamber, said at least one hollow member includes a pair of hollow projecting legs, each defined by opposing leg portions of said contoured bodies of said at least one hollow member, and each hollow projecting leg being in telescopic relationship to one of said hollow side members.

2. The sign as defined in claim 1 wherein said similarly peripherally contoured bodies are substantially identical to each other.

3. The sign as defined in claim 1 wherein each projecting leg is in interior telescopic relationship to one of said hollow side members.

4. The sign as defined in claim 1 wherein each of said upper and lower hollow members includes a pair of hollow projecting legs, and the pair of hollow projecting legs of said upper and lower hollow members are in respective telescopic relationship with upper and lower ends of said hollow side members.

5. The sign as defined in claim 1 wherein each of said upper and lower hollow members includes a pair of hollow projecting legs, and the pair of hollow projecting legs of said upper and lower hollow members are in respective interior telescopic relationship with upper and lower ends of said hollow side members.

6. The sign as defined in claim 1 including means for snap-securing said similar peripherally contoured bodies together in mating opposing relationship, said snap-securing means include both male and female cooperative snap fasteners located at substantially identical locations upon each of said two substantially similarly peripherally contoured bodies thereby effecting snap-securement in male-to-female relationship when said similarly peripherally contoured bodies are brought together in mating opposing relationship.

7. The sign as defined in claim 1 wherein said lower hollow member includes a downwardly projecting pedestal portion adapted to support said sign relative to a supporting surface.

8. The sign as defined in claim 1 wherein said upper hollow member includes means for suspending said sign relative to a supporting surface.

* * * * *